US005229350A

United States Patent [19]

Shinagawa et al.

[11] Patent Number: 5,229,350

[45] Date of Patent: Jul. 20, 1993

[54] REVERSIBLE HEAT-SENITIVE RECORDING MATERIAL AND MAGNETIC CARD USING THE RECORDING MATERIAL

[75] Inventors: Takae Shinagawa; Yoshihiro Hieda; Megumi Ashida; Yoshinori Yoshida; Yasushi Inoue, all of Osaka, Japan

[73] Assignee: Nitto Denko Corporation, Osaka, Japan

[21] Appl. No.: 732,003

[22] Filed: Jul. 18, 1991

[30] Foreign Application Priority Data

| | | | |
|---|---|---|---|
| Jul. 20, 1990 | [JP] | Japan | 2-193399 |
| Jan. 24, 1991 | [JP] | Japan | 3-25349 |
| Mar. 1, 1991 | [JP] | Japan | 3-61244 |
| Jun. 13, 1991 | [JP] | Japan | 3-169438 |

[51] Int. Cl.[5] ..... B41M 5/28

[52] U.S. Cl. ..... 503/201; 428/195; 428/694 R; 428/900; 428/913; 428/914; 503/214; 503/217

[58] Field of Search ..... 503/201, 208, 209, 217, 503/225, 214; 428/195, 694, 900, 913, 914

[56] References Cited

U.S. PATENT DOCUMENTS

| | | | |
|---|---|---|---|
| 4,917,948 | 4/1990 | Hotta | 428/195 |
| 4,977,030 | 12/1990 | Hotta et al. | 428/500 |

FOREIGN PATENT DOCUMENTS

| | | | |
|---|---|---|---|
| 3726015 | 2/1988 | Fed. Rep. of Germany | 503/201 |
| 3933487 | 4/1990 | Fed. Rep. of Germany | 503/201 |
| 2538309 | 6/1984 | France | 503/201 |
| 2135466A | 8/1984 | United Kingdom | 503/201 |

*Primary Examiner*—Pamela R. Schwartz

*Attorney, Agent, or Firm*—Sughrue, Mion, Zinn, Macpeak & Seas

[57] ABSTRACT

A reversible heat-sensitive recording material, a method of recording and erasing information using the recording material, and a magnetic card using the recording material, the recording material comprising a reversible heat-sensitive recording material comprising a heat-sensitive layer containing a resin matrix and an organic low molecular weight material, said organic low molecular weight material containing at least one higher fatty acid having 16 or more carbon atoms and a sulfide represented by the formula $$HOOC(CH_2)_m—S—(CH_2)_nCOOH \quad [I]$$

wherein m and n each independently means an integer of 1 to 5, the ratio of the amount of said at least one higher fatty acid to that of said sulfide being from 90:10 to 10:90 by weight.

28 Claims, 1 Drawing Sheet

FIGURE
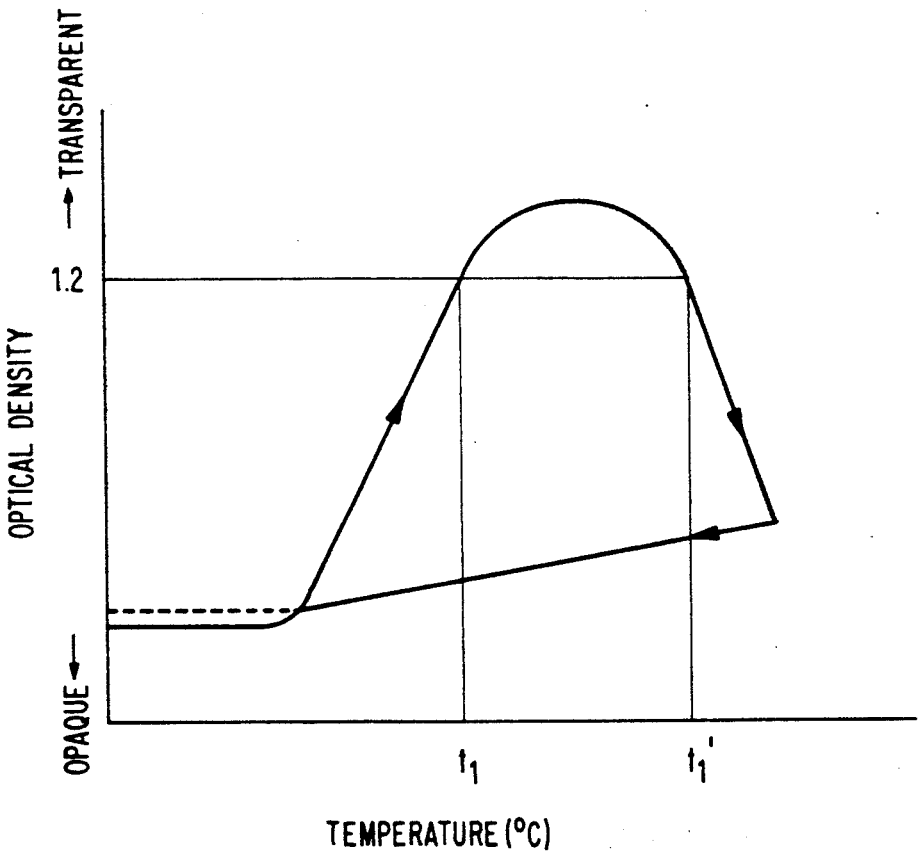

REVERSIBLE HEAT-SENITIVE RECORDING MATERIAL AND MAGNETIC CARD USING THE RECORDING MATERIAL

FIELD OF THE INVENTION

The present invention relates to a reversible heat-sensitive recording material in which an image can be formed and erased reversibly by means of temperature change, and a method of recording and erasion using the recording material. The present invention further relates to a magnetic card using the above reversible heat-sensitive recording material.

BACKGROUND OF THE INVENTION

With the recent spread of thermal heads, the demand for heat-sensitive recording materials is increasing rapidly. In prepaid cards, in particular, which show expeditious progress in the fields of communication, transportation, distribution, and the like, many kinds of techniques for displaying magnetic information as visible information on the cards have come to be used. Such magnetic cards are being used extensively, and examples thereof include highway cards, prepaid cards for use in department stores, supermarkets, etc., JR orange cards (Trade mark), and the like.

However, since an area which can be used to display visible information is limited, there are cases where in the case of large-denomination prepaid cards, for example, renewed information concerning the balance becomes unable to be added any more. Such cards are normally replaced with reissued cards and this has been disadvantageous in cost, etc.

In order to overcome the above problem, studies are being made on a reversible recording material in which recording and erasion of information can be conducted repeatedly in the same area. Use of this material enables old information to erase and new information to display and, hence, avoids necessity of the issuance of a new card as a substitution for an old card in which renewed information cannot be displayed any more.

Conventionally proposed as such heat-sensitive materials in which information can be recorded and erased reversively are materials having a heat-sensitive layer comprising a resin matrix, such as poly(vinyl chloride), a vinyl chloride-vinyl acetate copolymer, a polyester, a polyamide, or the like, and an organic low molecular weight substance such as a higher alcohol, a higher fatty acid, or the like dispersed in the matrix (e.g., JP-A-54-119377, JP-A-55-154198, and JP-A-2-1363). (The term "JP-A" as used herein means an "unexamined published Japanese patent application".)

Formation and erasion of an image in such recording materials utilize a reversible change in transparency of the heat-sensitive layer by temperature changes. The Figure illustrates the transparency-opaqueness change for a reversible heat-sensitive recording material. The heat-sensitive layer in this recording material is in a transparent state in the temperature range of $t_1$—$t_1'$ and is in a milky and opaque state at temperatures of $t_1'$ or more. For heating the heat-sensitive recording layer, use of a thermal head is preferred particularly in the case where the recording layer has been formed on a magnetic card. That is, recording is, for example, conducted by making the initial state of the recording layer transparent and selectively heating the recording layer with a thermal head at a temperature of $t_1'$ or more to allow the heated area to turn milky and opaque, thereby to record a character or design. Alternatively, recording may be conducted by making the initial state of the recording layer milky and opaque and selectively heating the recording layer with a thermal head at a temperature in the range of from $t_1$ to $t_1'$ to allow the heated area to turn transparent. Erasion of the thus-recorded image is accomplished by heating the recording layer with a heated roll, thermal head, or the like at a temperature of $t_1$ to $t_1'$ in the case of the former recording technique and at a temperature of $t_1'$ or more in the case of the latter. However, the recording material disclosed in JP-A-55-154198 is defective in that since the temperature range in which the recording layer is transparent ($t_1$—$t_1'$: transparent-state temperature range) is as narrow as 1° to 2° C., it is almost impossible to control the heating temperature by means of a thermal head and, hence, the latter technique has been utterly unpractical. Although a recording material having a widened transparent-state temperature range has been proposed in JP-A-2-1363, the widened range has a width of only 2° to 3° C. and is hence still unpractical. In addition, the proposed recording material has had a permanence problem, for example, that because the transparent-state temperature range is in a low-temperature region, the recorded character or design disappears according to the ambient temperature. Further, since even a small amount of energy causes opaque state, there are attempts to use acrylic oligomers or various high temperature-boiling solvents (e.g. JP-A-63-104879, JP-A-63-107584, JP-A-63-179789 and JP-A-64-14078).

As described above, the conventional reversible heat-sensitive recording materials are disadvantageous in that the temperature range in which the heat-sensitive layer is transparent is narrow in any of these materials and that temperature control for making a partially opaque recording layer transparent or for forming a transparent image in a recording layer which is wholly opaque is not easy. Furthermore, in these recording materials, the temperatures at which the transparent state changes to the opaque state are as low as 70° C. or less, so that there has been a drawback that transparent parts of the recording layer wholly or partly turn opaque during the storage of the recording material.

There has been another problem in the conventional reversible thermorecording techniques that after recording is conducted using a thermal head or the like and the recorded image is erased by a suitable means, an impact mark remains in the area where the recorded image was erased. This impact mark impairs the appearance of the recording material because light scattering occurs in the impact mark according to the viewing angle. There is a further problem that if recording of a visible image is conducted repeatedly in the same area using a thermal head, the reversible recording layer is severely deformed by the heat and pressure applied.

SUMMARY OF THE INVENTION

The present inventors have conducted extensive studies to overcome the above problems. As a result, it has been found that by selecting at least one higher fatty acid having 16 or more carbon atoms as an organic low molecular weight material and combining it with a dicarboxydi(lower alkyl) sulfide having a higher melting point than the higher fatty acid, a reversible heat-sensitive recording material can be obtained which has a transparent-state temperature range which is in a higher temperature region and is wider than those of the conventionally known reversible heat-sensitive recording materials. The present invention has been completed based on this finding.

An object of the present invention is to provide a reversible heat-sensitive recording material which can form a high-contrast image and has the advantages of easy temperature control for recording and erasion, excellent permanence properties of the transparent-state heat-sensitive layer, and freedom from deformation even in repeated use, thereby eliminating the above-described problems.

Another object of the present invention is to provide a magnetic card using the above recording material.

A further object of the present invention is to provide a method of recording and erasion using the above recording material.

BRIEF DESCRIPTION OF THE DRAWING

The Figure is a graph illustrating the transparency-opaqueness change of the heat-sensitive layer in a reversible heat-sensitive recording material.

DETAILED DESCRIPTION OF THE INVENTION

The reversible heat-sensitive recording material in accordance with the present invention comprises a heat-sensitive layer containing a resin matrix and an organic low molecular weight material, the organic low molecular weight material containing at least one higher fatty acid having 16 or more carbon atoms and a sulfide represented by the formula $$HOOC(CH_2)_m—S—(CH_2)_nCOOH \quad [I]$$

wherein m and n each independently means an integer of 1 to 5, the ratio of the amount of the at least one higher fatty acid to that of the sulfide being from 90:10 to 10:90 by weight. In the present invention, the matrix preferably is a resin having a glass transition point ($T_g$) of 80° C. or higher.

The heat-sensitive layer in the recording material of the present invention can be allowed to undergo a reversible change in transparency, so that recording and erasion of information can be conducted repeatedly. Therefore, visible information can be recorded on the heat-sensitive layer by means of a thermorecording apparatus such as a thermal head, and the recorded information can be erased and new information can be recorded using the same apparatus. Thus, rewriting or renewal of information is possible with the recording material of the present invention.

In the recording material of the present invention, recording of a visible image on the heat-sensitive layer is based on a difference between the transparent state and the milky and opaque state which are thermally reversible, that is, the recording utilizes the change in transparency of the heat-sensitive layer due to temperature changes. This phenomenon is assumed as follows.

When the heat-sensitive layer is transparent, each of the crystalline particles of the organic low molecular weight material dispersed in the resin matrix becomes single-crystalline, so that light incident upon the heat-sensitive layer on one side thereof penetrates the layer and reaches the other side of the layer without scattering and, hence, the heat-sensitive layer has a transparent appearance. On the other hand, when the heat-sensitive layer is milky and opaque, each of the particles of the organic low molecular weight material becomes polycrystalline, i.e., made up of minute crystals of the organic low molecular weight material, with the crystalline axes being oriented randomly, so that light incident upon the layer on one side thereof is refracted and scattered many times at interfaces between crystals of the organic low molecular weight material and, hence, the heat-sensitive layer has a milky and opaque appearance. Therefore, when the organic low molecular weight material is heated to a temperature not lower than the melting point thereof and is then cooled, the crystalline particles become polycrystalline, making the heat-sensitive layer milky and opaque. When the organic low molecular weight material is heated to a temperature not higher than the melting point thereof and is then cooled, the particles become single-crystalline, making the layer transparent. Thus, an image can be formed and erased.

The heat-sensitive layer in the recording material of the present invention can have a transparent-state temperature range which is in a higher-temperature region and is wider than those of the conventional heat-sensitive layers. Such an effect has been brought about by the combined use of at least one higher fatty acid having 16 or more carbon atoms and a sulfide represented by the above-described formula [I]and having a higher melting point than the higher fatty acid, as an organic low molecular weight material in the heat-sensitive layer. This is considered to be because the temperatures at which the higher fatty acid and the sulfide melt together upon heating are higher and in a wider range than that for the higher fatty acid alone.

The present inventors have made further extensive studies concerning impact marks remaining in the area in which a recorded image was erased. In generally employed conventional techniques, recording of a character or design is conducted by selectively heating the heat-sensitive layer in a transparent state at a temperature not lower than $t_1'$ thereby to allow the heated area to turn milky and opaque, and erasion of the recorded image is accomplished by heating the heat-sensitive layer at a lower temperature ($t_1$—$t_1'$) thereby to make the layer transparent. In such a technique, the reversible heat-sensitive layer suffers a deformation due to the heat and pressure applied by the thermal head when recording is conducted at a temperature as high as $t_1'$ or more, and erasion of the recorded image at a lower temperature of $t_1$ to $t_1'$ causes the deformation to remain as an impact mark, resulting in an impaired appearance.

In contrast, according to the method of the present invention, recording is conducted by selectively heating the heat-sensitive layer which is in an initial milky and opaque state with a thermal head or by other means to make the heated area transparent, and the recorded image is erased by applying a higher energy, i.e., heating the heat-sensitive layer at a higher temperature with a thermal head, thereby making the heat-sensitive layer milky and opaque. In this method, impact marks are completely concealed and there is completely no erasion miss resulting from unevenness in thermal head temperature, so that recording and erasion can be carried out very satisfactorily.

The resin matrix used in the heat-sensitive layer in the recording material of the present invention serves to hold a uniformly dispersed organic low molecular weight material thereby to form the heat-sensitive layer, and it greatly affects the transparency of the layer in its most transparent state. It is, therefore, preferred that the resin matrix be a resin having good transparency, high mechanical stability, and good film-forming properties. Such a matrix resin preferably has a glass transition point ($T_g$) of 80° C. or more. Examples thereof include poly(vinyl chloride) and vinyl chloride-based copolymers such as vinyl chloride-vinyl acetate copolymers, vinyl chloride-vinyl acetate-vinyl alcohol copolymers, vinyl chloride-acrylate copolymers, and the like; poly(vinylidene chloride) and vinylidene chloride-based copolymers such as vinylidene chloride-vinyl chloride copolymers, vinylidene chloride-acrylonitrile copolymers, and the like; poly(vinyl acetal) resins such as poly(vinyl formal), poly(vinyl butyral), and the like; acrylic resins such as polyacrylates, polymethacrylates, acrylate-methacrylate copolymers, and the like; and other resins including polyesters, polystyrene, styrene-butadiene copolymers, polyarylates, polycarbonates, polysulfones, aromatic polyamides, phenoxy resins, cellulosic resins, and the like. These matrix resins can be used alone or as a mixture of two or more thereof.

In combination with the above-described resin matrix, a resin having a $T_g$ of less than 80° C. can be used if required and necessary. Examples of such a resin include olefin resins such as polyethylene, polypropylene, and the like, poly(vinyl chloride) and vinyl chloride-based copolymers such as vinyl chloride-vinyl acetate copolymers, vinyl chloride-vinyl acetate-vinyl alcohol copolymers, vinyl chloride-acrylate copolymers, and the like, poly(vinylidene chloride) and vinylidene chloride-based copolymers such as vinylidene chloride-vinyl chloride copolymers, vinylidene chloride-acrylonitrile copolymers, and the like, poly(vinyl acetal) resins such as poly(vinyl formal), poly(vinyl butyral), and the like, polystyrene and styrene copolymers, polyesters, silicone resins, aliphatic polyamides, and the like. These resins can be used alone or as a mixture of two or more thereof. In the case where a resin having a $T_g$ of 80° C. or less is used in combination with a resin having a $T_g$ of 80° C. or more, the blend ratio can be suitably determined according to the desired recording properties.

The organic low molecular weight material comprises a mixture of at least one higher fatty acid having 16 or more carbon atoms and a sulfide represented by the formula $HOOC(CH_2)_n—S—(CH_2)_nCOOH$ [I]. By the combined sulfide with a higher fatty acid having 16 or more carbon atoms, the transparent-state temperature range can be widened and shifted to the higher-temperature side.

Specific examples of the higher fatty acid having 16 or more carbon atoms include palmitic acid, margaric acid, stearic acid, nonadecanoic acid, eicosanoic acid, heneicosanoic acid, behenic acid, lignoceric acid, pentacosanoic acid, cerotic acid, heptacosanoic acid, montanic acid, nonacosanoic acid, melissic acid, 2-hexadecenoic acid, trans-3-hexadecenoic acid, 2-heptadecenoic acid, trans-2-octadecenoic acid, cis-2-octadecanoic acid, trans-4-octadecenoic acid, cis-6-octadecenoic acid, elaidic acid, vaccenic acid, trans-gondonic acid, erucic acid, selacholeic acid, trans-selacholeic acid, trans-8,trans-10-octadecadienoic acid, linoelaidic acid, α-eleostearic acid, β-eleostearic acid, pseudoeleostearic acid, 12,20-heneicosadienoic acid, and the like. These can be used alone or as a mixture of two or more thereof.

Specific examples of the sulfide include (1,1'-dicarboxy)dimethyl sulfide, (2,2'-dicarboxy)diethyl sulfide, (3,3'-dicarboxy)dipropyl sulfide, (1,2'-dicarboxy)(methyl ethyl) sulfide, (1,3'-dicarboxy)(methyl propyl) sulfide, (1,4'-dicarboxy)(methyl butyl) sulfide, (2,3'-dicarboxy)(ethyl propyl) sulfide, (2,4'- dicarboxy)(ethyl butyl) sulfide, (5,5'-dicarboxy)dipentyl sulfide, and the like. These may be used alone or as a mixture of two or more thereof.

The blend ratio of the higher fatty acid to the sulfide is from 90:10 to 10:90 by weight, preferably from 90:10 to 30:70 by weight, more preferably from 85:15 to 50:50 by weight. If the amount of the sulfide is below the lower limit specified above, the transparent-state temperature range cannot be widened, while too large amounts thereof result in a significantly impaired contrast.

The relative amount of the resin matrix in the heat-sensitive layer is preferably from 50 to 1,600 parts by weight, more preferably from 100 to 500 parts by weight, per 100 parts by weight of the organic low molecular weight material. If the amount of the matrix in the heat-sensitive layer is below 50 parts by weight per 100 parts by weight of the organic low molecular weight material, it is difficult to form a film in which the organic low molecular weight material is kept stably in the matrix. On the other hand, if the matrix amount exceeds 1,600 parts by weight, the relative amount of the organic low molecular weight material which becomes milky and opaque is so small that the resulting recording material is disadvantageous in that recorded information cannot be clearly read. It is preferred that in the heat-sensitive layer, the organic low molecular weight material is uniformly dispersed in the matrix and sufficiently fixed by the matrix. Part of the organic low molecular weight material may be dissolved in the matrix.

In producing the heat-sensitive recording material of the present invention, a coating liquid is generally prepared by dissolving both of the matrix resin and the organic low molecular weight material in a solvent, or by dissolving the matrix resin in a solvent which does not dissolve at least one component of the organic low molecular weight material, finely dispersing the organic low molecular weight material into the matrix resin solution, and then dissolving a high temperature-boiling solvent in the dispersion. The thus-obtained coating liquid is coated on a support such as a plastic, glass plate, metal plate, paper, cloth, or the like and then dried, thereby to form a heat-sensitive layer.

According to the kinds of the matrix resin and organic low molecular weight material, a suitable solvent for use in forming the heat-sensitive layer is selected from various compounds. Examples of the solvent include tetrahydrofuran, methyl ethyl ketone, methyl isobutyl ketone, chloroform, carbon tetrachloride, ethanol, toluene, benzene, and the like. Even in the case where the coating liquid used is in a solution form, as well as in a dispersion form, the organic low molecular weight material present in the resulting heat-sensitive layer is in a dispersed state because the organic low molecular weight material is separated out as fine particles from the solution-form coating liquid.

The thickness of the heat-sensitive layer is generally from 1 to 50 μm, preferably from 1 to 30 μm, although it varies according to use. If the heat-sensitive layer thickness is larger than 50 μm, heat transfer from a thermal head becomes insufficient. Heat-sensitive layer thicknesses below 1 μm are also not preferred because the attainable contrast (degree of milky opaqueness) becomes low. The above thickness limitation does not apply to the case where heating means other than thermal heads are used.

A heat-fusible resin may be used as another kind of additive which extends the temperature range in which the heat-sensitive layer is in its most transparent state. This heat-fusible resin is one which in itself is compatible at least with the resin matrix and is semisolid or solid at ordinary temperature. Such a resin is generally called a tackifier resin and is added for the purpose of imparting adhesive properties in the production of pressure-sensitive adhesive compositions using a rubber component such as a synthetic or natural rubber and/or a synthetic resin component. The heat-fusible resin preferably has a softening point of 40° C. or more, an SP value (solubility parameter) of from 7.0 to 9.8, and a number-average molecular weight of from 200 to 2,500. If a heat-fusible resin having a softening point below 40° C. is used, there are cases where this resin bleeds from the heat-sensitive layer when the reversible recording material is stored or used at high temperatures. If a heat-fusible resin having an SP value outside the above-specified range is used, the desired recording performance cannot be obtained because such a heat-fusible resin has poor compatibility with the resin matrix. Examples of preferred heat-fusible resins include natural resins such as rosins and dammar; modified rosins or derivatives thereof such as polymerized rosins and partially or wholly hydrogenated rosins; polyterpene resins such as polymers of α- or β-pinene; terpene-modified products such as terpene-phenol copolymers and α-pinene-phenol copolymers; aliphatic hydrocarbon resins such as polymers of olefins or diolefins; aromatic petroleum resins; cyclopentadiene-based resins; phenolic resins such as alkylphenol-based resins and modified phenol-based resins; and other resins including alkylphenol-acetylene resins, styrene resins, xylene resins, coumarone-indene resins, vinyltoluene-α-methylstyrene copolymers, and the like. However, other available heat-fusible resins than the above may also be used.

By the addition of such a heat-fusible resin, the temperature range in which the heat-sensitive layer of the recording material is in a transparent state is widened. Since the above-enumerated resins are semisolid or solid at ordinary temperature, any of these has good stability and does not migrate or bleed. Therefore, the heat-fusible resin does not impair the appearance and recording performance of the recording material even in the long-term use or storage of the recording material. The heat-fusible resin is added in an amount of generally from 0.1 to 50 parts by weight, preferably from 1 to 30 parts by weight, per 100 parts by weight of the resin matrix. If the amount of the heat-fusible resin added is below 0.1 part by weight, the above-described effect cannot be obtained. If the amount thereof is larger than 50 parts by weight, the resulting composition for forming the heat-sensitive layer has poor film-forming properties.

If required and necessary, other various additives such as a lubricant, antistatic agent, plasticizer, dispersant, stabilizer, inorganic or organic filler, and the like can be added to the reversible heat-sensitive recording layer.

It is preferred to form an overcoat layer on the reversible heat-sensitive recording layer to protect the recording layer against a heating apparatus such as a thermal head during recording, because the overcoat layer enables the heat-sensitive layer to show improved durability when subjected to repeated recording and erasion. For forming this overcoat layer, an organic material such as a silicone resin, acrylic resin, fluoroplastic, polyurethane, or the like or an inorganic material such as $SiO_2$, SiO, MgO, ZnO, $TiO_2$, $Al_2O_5$, $Ta_2O_5$, or the like can be used. The reversible heat-sensitive recording layer can be formed on a support directly or through the medium of a primer layer, and the overcoat layer or the like can also be formed on the heat-sensitive layer directly or through the medium of a primer layer. The thickness of the overcoat layer is generally from 0.01 to 10 μm, preferably from 0.1 to 5 μm. Overcoat layer thicknesses outside the above range are not preferable in that thicknesses thereof below 0.01 μm decrease the effect of the overcoat layer, while thicknesses thereof exceeding 10 μm result in impaired heat sensitivity because the heat applied for recording or erasion is prevented from being transmitted to the heat-sensitive layer.

The reversible recording material of the present invention and the method of recording and erasing information using the recording material are advantageously applied particularly to a magnetic card. In this case, the reversible heat-sensitive recording layer can be formed either on the magnetic layer or on the side opposite to the magnetic layer. Further, the heat-sensitive recording layer can be formed over the whole surface of the card or on part of the surface. In producing such a magnetic card by providing the reversible heat-sensitive recording material of the present invention, the provision of the recording layer can be conducted through the medium of a primer layer, if required and necessary, in order to improve adhesion to the support. For the purpose of improving readability or recognizability, a colored layer or a metallic reflective layer made of Al, Ag, Sn, or the like may be formed beneath the reversible heat-sensitive recording layer.

Such a magnetic card having a reversible heat-sensitive recording layer can be used in a variety of fields. Application examples thereof include highway cards, various prepaid cards for use in department stores, supermarkets, etc., JR orange cards, stored fare cards, and the like.

As described above, the reversible heat-sensitive recording material of the present invention has a transparent-state temperature range which has been shifted to the higher-temperature side and widened, due to the combined use of a higher fatty acid having 16 or more carbon atoms and a specific sulfide as the organic low molecular weight material. Because of this, transparent areas in the heat-sensitive layer have improved permanence properties, and temperature control for making the whole recording layer transparent or for forming a transparent image on a milky and opaque ground has become easy. Further, the method of recording and erasion according to the present invention is excellent in that recording and erasion can be conducted repeatedly without leaving impact marks on the recording area. Furthermore, by the use of a resin having a $T_g$ of 80° C. or more as a resin matrix, the heat-sensitive layer becomes free from deformation due to the heat and pressure applied by a thermal head or the like and, hence, has significantly improved durability.

Also, by additionally using the heat-fusible resin, the reversible heat-sensitive recording material of the present invention has a large width of transparent-state temperature range, and an appearance or recording characteristic does not deteriorate even after storage over a long period of time. In addition, the reversible heat-sensitive recording material of the present invention can maintain excellent reversibility even after repeating use of recording-erasion, and can be used for magnetic cards, and the like.

The heat-sensitive recording material of the present invention will be explained in more detail by reference to the following examples, which should not be construed as limiting the scope of the invention. In these examples, all parts are by weight.

EXAMPLE 1

| Ingredient | Amount |
|---|---|
| Behenic acid ($C_{21}H_{43}COOH$) | 70 parts |
| (2,2'-Dicarboxy)diethyl sulfide (Thiodipropionic acid) | 30 parts |
| Vinyl chloride-vinyl acetate copolymer (VYHH, manufactured by UCC Co.) | 250 parts |
| Tetrahydrofuran | 1,200 parts |

A solution of the above ingredients was coated on a 188 μm-thick poly(ethylene terephthalate)(PET) film with a wire-wound bar and heat-dried to form a heat-sensitive recording layer having a thickness of 20 μm. A solution having the following composition was then coated on the heat-sensitive layer with a wire-wound bar and heat-dried to form an overcoat layer having a thickness of 0.5 μm, thereby obtaining a recording material.

| | |
|---|---|
| Silicone-based acrylate hard coating (X-12-2150A, manufactured by Shin-Etsu Chemical Co., Ltd., Japan) | 10 parts |
| Catalyst (X-12-2150B, manufactured by Shin-Etsu Chemical Co., Ltd.) | 1 part |

EXAMPLE 2

| Ingredient | Amount |
|---|---|
| Behenic acid ($C_{21}H_{43}COOH$) | 70 parts |
| (2,2'-Dicarboxy)diethyl sulfide (Thiodipropionic acid) | 30 parts |
| Vinyl chloride-vinyl acetate copolymer (VYHH, manufactured by UCC Co.) | 250 parts |
| 1,3-Pentadiene polymer (Softening point 100° C.) | 20 parts |
| Tetrahydrofuran | 1,200 parts |

A solution of the above ingredients was coated on a 188 μm-thick poly(ethylene terephthalate)(PET) film with a wire-wound bar and heat-dried to form a heat-sensitive recording layer having a thickness of 20 μm. A solution having the following composition was then coated on the heat-sensitive layer with a wire-wound bar and heat-dried to form an overcoat layer having a thickness of 0.5 μm, thereby obtaining a recording material.

| | |
|---|---|
| Silicone-based acrylate hard coating (X-12-2150A, manufactured by Shin-Etsu Chemical Co., Ltd., Japan) | 10 parts |
| Catalyst (X-12-2150B, manufactured by Shin-Etsu Chemical Co., Ltd.) | 1 part |

EXAMPLE 3

A recording material was obtained in the same manner as in Example 2 except that the amount of behenic acid was changed to 50 parts and that of (2,2'-dicarboxy)diethyl sulfide was changed to 50 parts.

EXAMPLE 4

A recording material was obtained in the same manner as in Example 2 except that the amount of behenic acid was changed to 30 parts and that of (2,2'-dicarboxy)diethyl sulfide was changed to 70 parts.

EXAMPLE 5

A recording material was obtained in the same manner as in Example 2 except that the amount of behenic acid was changed to 10 parts and that of (2,2'-dicarboxy)diethyl sulfide was changed to 90 parts.

EXAMPLE 6

A recording material was obtained in the same manner as in Example 2 except that stearic acid was used in place of behenic acid.

EXAMPLE 7

A recording material was obtained in the same manner as in Example 2 except that 35 parts of behenic acid and 35 parts of palmitic acid ($C_{15}H_{31}COOH$) were used in place of 70 parts of behenic acid.

EXAMPLE 8

A recording material was obtained in the same manner as in Example 2 except that (1,1'-dicarboxy)-dimethyl sulfide was used in place of (2,2'-dicarboxy)-diethyl sulfide.

EXAMPLE 9

A recording material was obtained in the same manner as in Example 2 except that (3,3'-dicarboxy)dipropyl sulfide was used in place of (2,2'-dicarboxy)diethyl sulfide.

EXAMPLE 10

A recording obtained in the same manner as in Example 2 except that (1,3'-sulfide dicarboxy)(methyl propyl) was used in place of (2,2'-dicarboxy)diethyl sulfide.

EXAMPLE 11

A recording material was obtained in the same manner as in Example 7 except that (5,5'-dicarboxy)dipentyl sulfide was used in place of (2,2'-dicarboxy)diethyl sulfide.

COMPARATIVE EXAMPLE 1

A recording material was obtained in the same manner as in Example 2 except that the amount of behenic acid was changed to 98 parts and that of (2,2'-dicarboxy)diethyl sulfide was changed to 2 parts.

COMPARATIVE EXAMPLE 2

A recording material was obtained in the same manner as in Example 2 except that the amount of behenic acid was changed to 2 parts and that of (2,2'-dicarboxy)-diethyl sulfide was changed to 98 parts.

COMPARATIVE EXAMPLE 3

A recording material was obtained in the same manner as in Example 2 except that the amount of behenic acid was changed to 100 parts and (2,2'-dicarboxy)-diethyl sulfide was not used.

COMPARATIVE EXAMPLE 4

A recording material was obtained in the same manner as in Example 2 except that distearyl thiodipropionate $[S(CH_2CH_2COO(CH_2)_{17}CH_2)_2]$ was used in place of (2,2'-dicarboxy)diethyl sulfide.

Each of the recording materials obtained in the above Examples and Comparative Examples was evaluated by the following methods. The results obtained are shown in Table 1.

Optical density:

A milky and opaque image area and a transparent area resulting from erasion of the image were placed on a standard blackboard, and the optical densities of these areas were measured with densitometer Macbeth RD-920 (manufactured by Macbeth Co.).

Transparent-state temperature range:

Each recording material was heated stepwise 1° C. by 1° C. from 50° C. and then cooled to room temperature, while optical density measurement was being conducted according to the above-described method. A temperature range in which the recording material had optical densities of 1.20 or more was regarded as the transparent-state temperature range.

TABLE 1

| | Transparent-state temperature range (°C.) | Width of the transparent-state temperature range (°C.) |
|---|---|---|
| Example 1 | 80–100 | 20.0 |
| Example 2 | 80–102 | 22.0 |
| Example 3 | 80–109 | 29.0 |
| Example 4 | 81–116 | 35.0 |
| Example 5 | 80–113 | 33.0 |
| Example 6 | 68–91 | 23.0 |
| Example 7 | 65–95 | 30.0 |
| Example 8 | 81–103 | 22.0 |
| Example 9 | 81–110 | 29.0 |
| Example 10 | 82–112 | 30.0 |
| Example 11 | 66–98 | 32.0 |
| Comparative Example 1 | 78–82 | 4.0 |
| Comparative Example 2 | 88–92 | 4.0 |
| Comparative Example 3 | 74–78 | 4.0 |
| Comparative Example 4 | None | 0 |

EXAMPLE 12

The same solution for forming a recording layer as used in Example 2 was coated on a 100 μm-thick PET film with a wire-wound bar at a thickness of 15 μm on a dry basis, thereby to form a reversible heat-sensitive recording layer. This recording material was then placed in a 120° C. drying chamber for 1 minute to make the initial state of the heat-sensitive recording layer milky and opaque. Characters were then printed on the resulting recording material using a 8 dot/mm thin-film line head at an applied energy of 0.2 mJ, and the printed characters were erased by superposing solid images at an applied energy of 0.4 mJ.

EXAMPLE 13

The same solution for forming a recording layer as used in Example 2 was coated with a wire-wound bar on a magnetic card on the magnetic layer side at a thickness of 10 μm on a dry basis. Using this magnetic card, recording and erasion were conducted in the same manner as in Example 12 except that the initial state of the recording layer was made milky and opaque by placing the card in a 120° C. drying chamber for 1 minute.

COMPARATIVE EXAMPLE 5

The reversible recording material as obtained in Example 12 was placed in a 80° C. drying chamber for 1 minute, thereby making the initial state of the heat-sensitive recording layer transparent. Characters were then printed on the resulting recording material using a 8 dot/mm thin-film line head at an applied energy of 0.4 mJ, and the printed characters were erased by superposing solid images at an applied energy of 0.2 mJ.

COMPARATIVE EXAMPLE 6

The reversible recording material as obtained in Example 13 was placed in a 80° C. drying chamber for 1 minute, thereby making the initial state of the heat-sensitive recording layer transparent. Characters were then printed on the resulting recording material using a 8 dot/mm thin-film line head at an applied energy of 0.4 mJ, and the printed characters were erased by superposing solid images at an applied energy of 0.2 mJ.

COMPARATIVE EXAMPLE 7

| | |
|---|---|
| Behenic acid | 95 parts |
| $(CH_2)_{10}(COOH)_2$ | 5 parts |
| Vinyl chloride-vinyl acetate copolymer (VYHH, manufactured by UCC Co.) | 250 parts |
| DOP | 30 parts |
| Tetrahydrofuran | 1,500 parts |

A solution having the above composition was coated on a 100 μm-thick PET film at a thickness of 15 μm on a dry basis, thereby to form a reversible heat-sensitive recording layer. The thus-obtained recording material was then placed in a 120° C. drying chamber for 1 minute to make the initial state of the heat-sensitive recording layer milky and opaque. Characters were then printed on the resulting recording material using a 8 dot/mm thin-film line head at an applied energy of 0.2 mJ, and the printed characters were erased by superposing solid images at an applied energy of 0.4 mJ.

With respect to each of the recording materials which had undergone printing and erasion in Examples 12 and 13 and Comparative Examples 5 to 7, that part of the heat-sensitive recording layer in which printed characters had been erased was examined. The recording materials which had undergone recording and erasion according to the method of Examples 12 and 13 had no traces of erased characters, i.e., impact marks, and were entirely in a milky and opaque state without unevenness. In contrast, in the case of the recording materials which had undergone recording and erasion according to the method of Comparative Examples 5 and 6, traces of erased characters were clearly observed and, further, part of the characters remained unerased due to the uneven temperature of the thermal head. In the case of the recording material of Comparative Example 7, it had a very narrow transparent-state temperature range and, hence, it was extremely difficult to control the recording temperature within the temperature range by the use of a thermal head and transparent characters could not be formed on a milky and opaque ground. Table 2 shows the transparent-state temperature ranges for the heat-sensitive recording materials of Examples 12 and 13 and Comparative Examples 5 to 7, of which the recording materials of Example 13 and Comparative Example 6 used a magnetic sheet as coating support in place of the 100-μm PET film.

TABLE 2

| | Transparent-state temperature range (°C.) | Width of the transparent-state temperature range (°C.) |
|---|---|---|
| Example 12 | 80–102 | 22 |
| Example 13 | 80–105 | 25 |
| Comparative Example 5 | 80–102 | 22 |
| Comparative Example 6 | 80–105 | 25 |
| Comparative Example 7 | 83–85 | 2 |

EXAMPLES 14 TO 25

| Ingredient | Amount |
|---|---|
| Behenic acid | 70 parts |
| Thiodipropionic acid | 30 parts |
| Vinyl chloride-vinyl acetate copolymer (VYHH, manufactured by UCC Co.) | 250 parts |
| Heat-fusible resin shown in Table 3 | 20 parts |
| Tetrahydrofuran | 1,200 parts |

A solution of the above ingredients was coated on a 100 μm-thick poly(ethylene terephthalate) film with an applicator at a dry film thickness of 15 μm to obtain a reversible heat-sensitive recording layer.

Each of the reversible heat-sensitive recording layers obtained was evaluated. The results obtained are shown in Table 3.

TABLE 3

| Example | Heat-fusible resin | Softening point (°C.) | Thickness (μm) | Transparent-state temperature range | Opaque-transparent | Width of transparent-state temperature range (°C.) |
|---|---|---|---|---|---|---|
| 14 | 1,3-Pentadiene polymer | 70 | 10 | 29.0 | 0.55–1.41 | 80.7–109.7 |
| 15 | 1,3-Pentadiene polymer | 96 | 10 | 32.0 | 0.55–1.46 | 85.9–117.9 |
| 16 | 1,3-Pentadiene polymer acid anhydride adduct | 96 | 10 | 37.2 | 0.58–1.45 | 82.3–119.5 |
| 17 | 1,3-Pentadiene-styrene polymer | 80 | 10 | 38.0 | 0.58–1.45 | 82.0–120.0 |
| 18 | 1,3-Pentadiene-styrene polymer | 115 | 10 | 36.0 | 0.58–1.43 | 82.5–118.5 |
| 19 | β-Pinene-dipentene polymer | 50 | 10 | 25.8 | 0.56–1.40 | 81.8–107.6 |
| 20 | β-Pinene-dipentene polymer | 60 | 10 | 37.6 | 0.54–1.41 | 82.4–120.0 |
| 21 | β-Pinene-dipentene polymer | 70 | 10 | 23.8 | 0.58–1.39 | 81.7–105.5 |
| 22 | β-Pinene-dipentene polymer | 100 | 10 | 40.1 | 0.59–1.43 | 82.1–122.2 |
| 23 | α-Pinene-phenol polymer | 50 | 10 | 20.3 | 0.53–1.40 | 81.7–102.0 |
| 24 | α-Pinene-phenol polymer | 80 | 10 | 37.7 | 0.64–1.46 | 82.0–119.7 |
| 25 | α-Pinene-phenol polymer | 145 | 10 | 24.1 | 0.56–1.44 | 81.4–105.5 |

A sheet having the reversible heat-sensitive recording layer obtained in Example 14 were subjected to an opaque-transparent repeating test in 30 cycles, one cylce comprising (140° C., 30 seconds)-(80° C., 30 seconds). After completion of the test, the sheet was stamped at 140° C. for 0.1 second under a load of 2 kg using a static heat-coloration device (manufactured by Ohkura Denki Co.). The printed density at this time was measured on a standard black board using a Macbeth densitometer RD-920, and was employed as a recording characteristic after the repeating test. The initial characteristic, printed density, of the recording material of Example 1 was 0.55, and the printed density after 30 recycles was 0.63.

EXAMPLES 26 TO 33 AND COMPARATIVE EXAMPLES 8 TO 10

Solutions were prepared according to the formulations shown in Table 4.

TABLE 4

| | Tg (°C.) | Comparative Example 26 | 27 | 28 | 29 | 30 | 31 | 32 | 33 | Example 8 | 9 | 10 |
|---|---|---|---|---|---|---|---|---|---|---|---|---|
| Resin | | | | | | | | | | | | |
| Polycarbonate | 145 | 20 | — | — | — | — | — | — | — | — | — | — |
| Phenoxy resin | 100 | — | 20 | — | — | — | — | — | — | — | — | — |
| Polyarylate | 203 | — | — | 20 | — | — | — | — | — | — | — | — |
| Poly(methyl methacrylate) | 105 | — | — | — | 20 | 1 | 10 | 14 | — | — | — | — |
| Vinyl chloride-vinyl acetate copolymer | 78 | — | — | — | — | 19 | 10 | 6 | — | 20 | — | — |
| Vinyl chloride-vinyl acetate copolymer | 82 | — | — | — | — | — | — | — | 20 | — | — | — |
| Poly(vinyl acetate) | 30 | — | — | — | — | — | — | — | — | — | 20 | — |
| Poly(vinylidene chloride) | −17 | — | — | — | — | — | — | — | — | — | — | 20 |
| Organic low molecular weight 1/15 material | | | | | | | | | | | | |
| Behenic acid | | 9 | 9 | 9 | 9 | 9 | 9 | 9 | 9 | 9 | 9 | 9 |

TABLE 4-continued

| | Tg (°C.) | Comparative Example 26 | 27 | 28 | 29 | 30 | 31 | 32 | 33 | Example 8 | 9 | 10 |
|---|---|---|---|---|---|---|---|---|---|---|---|---|
| (2,2'-Dicarboxy)diethyl sulfide | | 3 | 3 | 3 | 3 | 3 | 3 | 3 | 3 | 3 | 3 | 3 |
| Heat-fusible resin | | | | | | | | | | | | |
| 1,3-Pentadiene Polymer | | 2 | 2 | 2 | 2 | 2 | 2 | 2 | 2 | 2 | 2 | 2 |
| Solvent | | | | | | | | | | | | |
| THF | 120 | 120 | 120 | 120 | 120 | 120 | 120 | 120 | 120 | 120 | 120 | 120 |

Each of the solutions was coated on a 188 μm-thick PET film with a wire-wound bar at a thickness of 5 μm on a dry basis, thereby to form a reversible heat-sensitive recording layer. A solution having the following composition was then coated on the heat-sensitive recording layer with a wire-wound bar, and the coating was cured by means of a UV irradiator (UE-021-203C, manufactured by Eye-graphics Co., Ltd., Japan; UV dose, 500 mJ), thereby forming an overcoat layer having a thickness of 2 μm.

| | |
|---|---|
| Acrylic-urethane resin of UV-curing type | 100 parts |
| Methanol | 400 parts |

Each of the thus-obtained recording materials was subjected to 100 time printing-erasion cycling using a line-type thermal head (printing energy, 2.4 mJ/mm$^2$; erasing energy, 0.8 mJ/mm$^2$), and its surface state was then visually evaluated. As a result, the recording materials of the present invention which contained a resin having a glass transition point of 80° C. or more were found to be free from a surface deformation and show excellent suitability for repeated printing-erasion cycling. In contrast, the recording material of Comparative Example 8 had suffered a partial deformation, while those of Comparative Examples 9 and 10 had suffered a whole deformation.

While the invention has been described in detail and with reference to specific embodiments thereof, it will be apparent to one skilled in the art that various changes and modifications can be made therein without departing from the spirit and scope thereof.

What is claimed is:

1. A reversible heat-sensitive recording material comprising a heat-sensitive layer formed on a support wherein said heat-sensitive layer contains a resin matrix and an organic low molecular weight material, said organic low molecular weight material containing at least one higher fatty acid having 16 or more carbon atoms and a sulfide represented by the formula $$HOOC(CH_2)_m—S—(CH_2)_nCOOH \quad [I]$$

wherein m and n each independently represents an integer of 1 to 5, the ratio of the amount of said at least one higher fatty acid to that of said sulfide being from 90:10 to 10:90 by weight.

2. A reversible heat-sensitive recording material as claimed in claim 1, wherein said resin matrix has a glass transition point of 80° C. or more.

3. A reversible heat-sensitive recording material as claimed in claim 1, wherein said resin matrix is at least one member selected from the group consisting of poly(vinyl chloride), vinyl chloride-vinyl acetate copolymer, vinyl chloride-vinyl acetate-vinyl alcohol copolymer, vinyl chloride-acrylate copolymer, poly(vinylidene chloride), vinylidene chloride-vinyl chloride copolymer, poly(vinyl formal), poly(vinyl butyral), polyacrylate, polymethacrylate, acrylate-methacrylate copolymer, polystyrene, styrene-butadiene copolymer, polyacrylate, polycarbonate, polysulfone, aromatic polyamide, phenoxy resin, and cellulosic resin.

4. A reversible heat-sensitive recording material as claimed in claim 1, wherein said sulfide is (2,2'-dicarboxy)diethyl sulfide.

5. A method of recording and erasing information, which comprises heating the reversible heat-sensitive recording material as claimed in claim 1 which is in an initial milky and opaque state, thereby to allow the heated area of the heat-sensitive layer in the recording material to turn transparent and thus record information, and then heating the recording material to a temperature higher than the temperature at which the recording was conducted, thereby to allow the transparent area of the heat-sensitive layer to turn milky and opaque and thus erase the information.

6. A magnetic card obtained by forming a layer of a reversible heat-sensitive recording material on a magnetic card member, wherein said heat-sensitive recording material comprises a resin matrix and an organic low molecular weight material, said organic low molecular weight material containing at least one higher fatty acid having 16 or more carbon atoms and a sulfide represented by the formula $$HOOC(CH_2)_m—S—(CH_2)_nCOOH$$

wherein m and n each independently represents an integer of 1 to 5, the ratio of the amount of said at least one higher fatty acid to that of said sulfide being from 90:10 to 10:90 by weight.

7. A magnetic card as claimed in claim 6, wherein the magnetic card member includes a magnetic recording layer on one side thereof, and wherein the heat-sensitive recording material is provided on part or the whole of a surface of the magnetic card member on the magnetic recording layer side or the side opposite to the magnetic recording layer side.

8. A reversible heat-sensitive recording material comprising a heat-sensitive layer formed on a support, wherein said heat-sensitive layer contains a resin matrix and an organic low molecular weight material, said organic low molecular weight material comprising a) at least one higher fatty acid having 16 or more carbon atoms, b) a sulfide represented by the formula $$HOOC(CH_2)_m—S—(CH_2)_nCOOH \quad [I]$$

wherein m and n each independently represents an integer of 1 to 5, and c) a heat-fusible resin, the ratio of the amount of said at least one higher fatty acid to that of said sulfide being from 90:10 to 10:90 by weight.

9. A reversible heat-sensitive recording material as claimed in claim 8, wherein said resin matrix has a glass transition point of 80° C. or more.

10. A reversible heat-sensitive recording material as claimed in claim 8, wherein said resin matrix is at least one member selected from the group consisting of poly(vinyl chloride), vinyl chloride-vinyl acetate copolymer, vinyl chloride-vinyl acetate-vinyl alcohol copolymer, vinyl chloride-acrylate copolymer, poly(vinylidene chloride), vinylidene chloride-vinyl chloride copolymer, poly(vinyl formal), poly(vinyl butyral), polyacrylate, polymethacrylate, acrylate-methacrylate copolymer, polystyrene, styrene-butadiene copolymer, polyacrylate, polycarbonate, polysulfone, aromatic polyamide, phenoxy resin, and cellulosic resin.

11. A reversible heat-sensitive recording material as claimed in claim 8, wherein said sulfide is (2,2'-dicarboxy)diethyl sulfide.

12. A reversible heat-resistive recording material as claimed in claim 8, wherein said heat-fusible resin has a softening point of at least 40° C.

13. A reversible heat-sensitive recording material as claimed in claim 8, wherein said heat-fusible resin has a solubility parameter value of 7.0 to 9.8.

14. A reversible heat-sensitive recording material as claimed in claim 8, wherein said heat-fusible resin has a number average molecular weight of from 200 to 2,500.

15. A reversible heat-sensitive recording material as claimed in claim 8, wherein the amount of said heat-fusible resin is 0.1 to 50 parts by weight per 100 parts by weight of the resin matrix.

16. A reversible heat-sensitive recording material as claimed in claim 8, wherein said heat-fusible resin comprises a natural resin.

17. A reversible heat-sensitive recording material as claimed in claim 8, wherein said heat-fusible resin comprises a polyterpene resin.

18. A reversible heat-sensitive recording material as claimed in claim 8, wherein said heat-fusible resin comprises a terpene resin.

19. A reversible heat-sensitive recording material as claimed in claim 8, wherein said heat-fusible resin comprises an aliphatic hydrocarbon resin.

20. A reversible heat-sensitive recording material as claimed in claim 8, wherein said heat-fusible resin comprises an aromatic petroleum resin.

21. A reversible heat-sensitive recording material as claimed in claim 8, wherein said heat-fusible resin comprises a cyclopentadiene resin.

22. A reversible heat-sensitive recording material as claimed in claim 8, wherein said heat-fusible resin comprises a phenolic resin.

23. A reversible heat-sensitive recording material as claimed in claim 8, wherein said heat-fusible resin comprises an alkylphenol-acetylene resin.

24. A reversible heat-sensitive recording material as claimed in claim 8, wherein said heat-fusible resin comprises a styrene resin.

25. A reversible heat-sensitive recording material as claimed in claim 8, wherein said heat-fusible resin comprises a xylene resin.

26. A reversible heat-sensitive recording material as claimed in claim 8, wherein said heat-fusible resin comprises a coumarone-indene resin.

27. A reversible heat-sensitive recording material as claimed in claim 8, wherein said heat-fusible resin comprises a vinyltoluene-α-methylstyrene resin.

28. A magnetic card obtained by forming a layer of a reversible heat-sensitive recording material on a magnetic sheet, wherein said heat-sensitive recording material comprises a resin matrix and an organic low molecular weight material, said organic low molecular weight material comprising a) at least one higher fatty acid having 16 or more carbon atoms, b) a sulfide represented by the formula $$HOOC(CH_2)_m—S—(CH_2)_nCOOH$$

wherein m and n each independently represents an integer of 1 to 5, and c) a heat-fusible resin, the ratio of the amount of said at least one higher fatty acid to that of said sulfide being from 90:10 to 10:90 by weight.

* * * * *